US005228870A

United States Patent [19]

Gorenc et al.

[11] Patent Number: 5,228,870

[45] Date of Patent: Jul. 20, 1993

[54] CONNECTOR TO CIRCUIT BOARD SECURING ARRANGEMENT WITH HOLDING DEVICE INSERTION DEPTH COMPENSATOR

[75] Inventors: Daniel L. Gorenc, Harrisburg; Shane D. Northcraft, New Cumberland; Michael A. Woren, Harrisburg, all of Pa.

[73] Assignee: AMP Incorporated, Harrisburg, Pa.

[21] Appl. No.: 922,265

[22] Filed: Jul. 30, 1992

[51] Int. Cl.[5] ..... H01R 13/73

[52] U.S. Cl. ..... 439/567; 439/571

[58] Field of Search ..... 439/567, 571, 554, 558, 439/557

[56] References Cited

U.S. PATENT DOCUMENTS 4,907,987 3/1990 Douty et al. ..... 439/571

5,074,807 12/1991 Parmer ..... 439/557

5,135,412 8/1992 Sitzler ..... 439/571

5,154,634 10/1992 Brown et al. ..... 439/554

5,171,165 12/1992 Hwang ..... 439/567

*Primary Examiner*—Gary F. Paumen

*Attorney, Agent, or Firm*—William B. Noll

[57] ABSTRACT

An arrangement for securing an electrical connector (10) to a printed circuit board (14) includes a planar barbed holding device (12) installed within a recess (38) of a mounting portion (36) on the connector for subsequent insertion into an appropriately aligned cavity (40) in the printed circuit board. The recess is formed with an inner wall (62) for limiting insertion of the holding device and depth compensation protrusions (64) are provided on the inner wall to insure proper orientation and seating of the holding device within a required tolerance range.

3 Claims, 3 Drawing Sheets

CONNECTOR TO CIRCUIT BOARD SECURING ARRANGEMENT WITH HOLDING DEVICE INSERTION DEPTH COMPENSATOR

BACKGROUND OF THE INVENTION

This invention relates to electrical connectors and, more particularly, to an arrangement for securing an electrical connector to a printed circuit board.

There are numerous ways of securing an electrical connector to a printed circuit board. For example, the connector can be formed with mounting flanges having bores which align with corresponding openings in the printed circuit board. Threaded fasteners can then be extended through the bores and openings for securement of the connector. While effective for securement, this technique has disadvantages from at least the standpoints of component part count and assembly time.

As an alternative to the aforementioned, there have been developed arrangements whereby a generally planar barbed holding device secured to the connector is inserted into a circuit board opening. U.S. Pat. No. 4,907,987 discloses such an arrangement wherein a holding device is extended through an opening in a connector mounting flange and is secured thereto by an interference fit. This holding device is inserted into the mounting flange from the side of the flange which is remote from the circuit board. The end of the holding device extending out from the mounting flange on the side abutting the circuit board has spring means with barbs thereon which engage the walls of the circuit board opening. The present invention is concerned with an improved holding device which is inserted into an appropriate recess in a mounting portion from the same side as the circuit board. With such an arrangement, it is important that the holding device be inserted the proper distance into the recess and at the same time have a stable orientation. It is therefore a primary object of the present invention to provide an arrangement which satisfies these requirements.

SUMMARY OF THE INVENTION

The foregoing and additional objects are attained in accordance with the principles of this invention by providing a holding device formed as a unitary planar piece of uniform thickness and having first and second barbed projections extending in opposite directions from a central crossarm. The first and second projections define a major axis of the holding device. The mounting portion of the member to be secured to the circuit board is formed with a recess for receiving the holding device, the recess having an outer portion open to the mounting surface of the member and an inner portion remote from the mounting surface. The inner portion is sized for an interference fit with the barbs of the first projection of the holding device and the outer portion is sized to freely accept the central crossarm of the holding device. The outer portion has a generally flat inner wall parallel to the mounting surface and flanking the inner portion. A depth compensator for locating the holding device in the recess is provided. The depth compensator includes a pair of protrusions formed on the inner wall and extending equally from the inner wall, one on either side of the inner portion of the recess. These protrusions engage an edge of the crossarm when the holding device is fully seated in the recess and are deformable to insure that all tolerances are met.

In accordance with an aspect of this invention, each of the protrusions is semi-cylindrical in shape with an axis extending parallel to the inner wall across the thickness of the recess.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
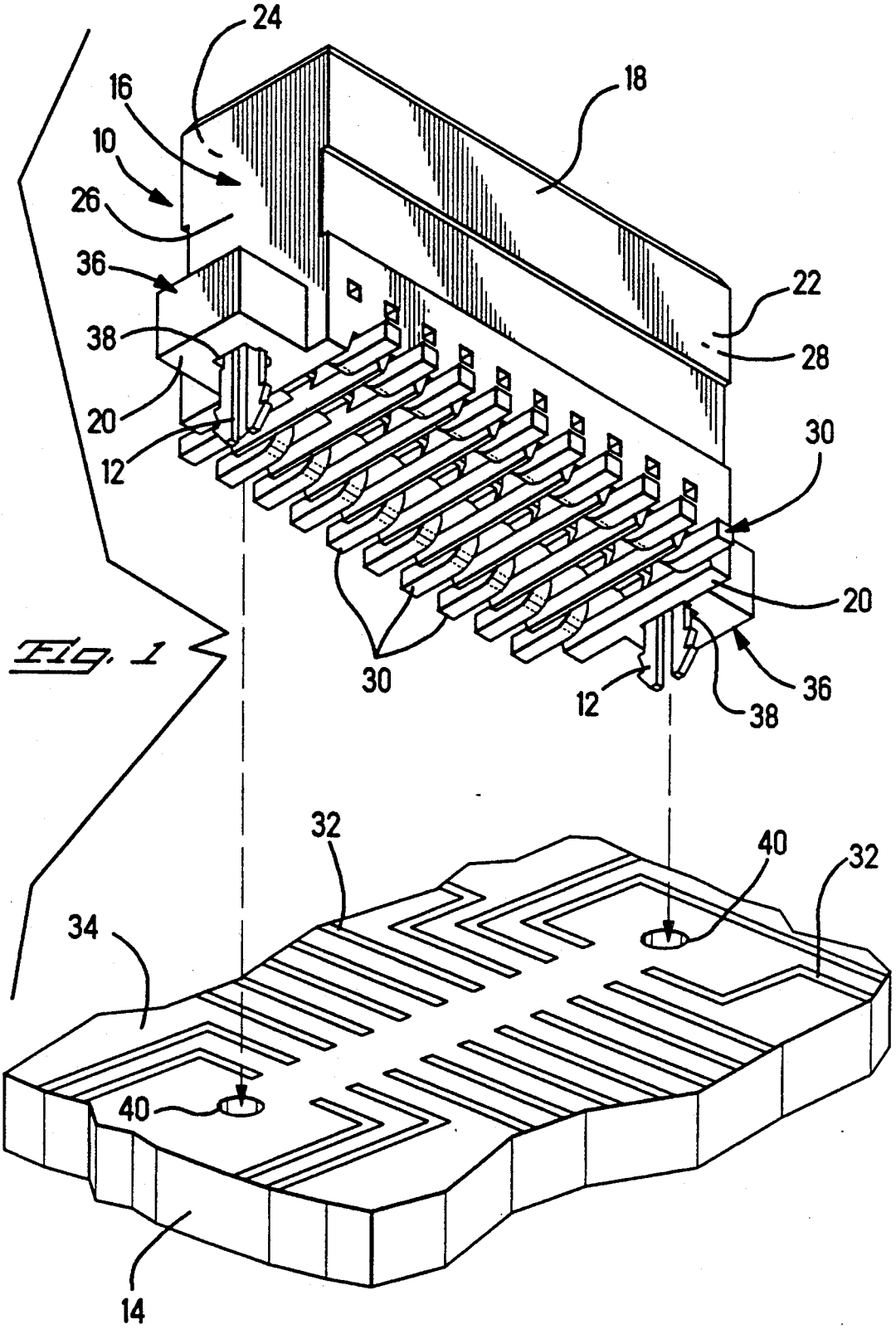
FIG. 1 is a perspective view of an electrical connector including a holding device according to this invention exploded from a printed circuit board.

Referring to the drawings, FIG. 1 shows an electrical connector 10 including a holding device 12, exploded from a printed circuit board 14. The connector 10 has a housing 16 molded of thermoplastic material and having a mating face 18, an opposed mounting face 20, opposed side walls 22, 24 and opposed end walls 26, 28. As is conventional, the connector 10 includes a plurality of terminals 30 held within terminal receiving passageways of the housing 16. The terminals 30 are illustratively for surface mount termination to traces 32 on the upper, or mounted, surface 34 of the printed circuit board 14. The connector 10 is also illustratively formed with a pair of mounting portions 36, which may be in the form of flanges or may be integral with the housing, each mounting portion 36 having a recess 38 therein for receiving a respective holding device 12. The printed circuit board 14 is formed with generally cylindrical cavities 40 aligned with the recesses 38 when the connector 10 is mounted to the printed circuit board 14 so that the holding devices 12 may be received therein.

Figure 2:
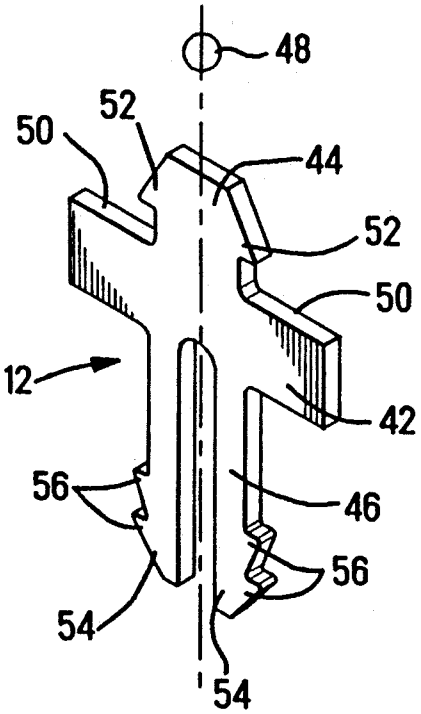
FIG. 2 is an enlarged perspective view of the holding device shown in FIG. 1.

As shown in FIG. 2, the holding device 12 is formed as a unitary planar piece having uniform thickness and is preferably stamped from flat sheet stock material, which may illustratively be, for example, a heat treated steel or a copper alloy. The holding device 12 has a central crossarm section 42 and first and second projections 44 and 46, respectively, extending in opposite directions from the central crossarm section 42 within the plane of the holding device 12. Together, the first and second projections 44, 46 define a major axis 48 of the holding device 12. The central crossarm section 42 extends transverse to the axis 48 and laterally beyond the projections 44, 46. Adjacent to the first projection 44, the central crossarm section 42 is formed with an edge 50 which is orthogonal to the axis 48. The first projection 44 is formed with a pair of barbs 52 for the purpose of retaining the holding device 12 within the recess 38 of the mounting portion 36, as will be described hereinafter. The second projection 46 is bifurcated along the axis 48 into a pair of separated legs 54. Each of the legs 54 is formed with a pair of barbs 56 which are directed away from the other of the legs 54. The barbs 56 are for the purpose of retaining the holding device 12 within the cavity 40 of the circuit board 14, as will be described hereinafter.

Figure 4:
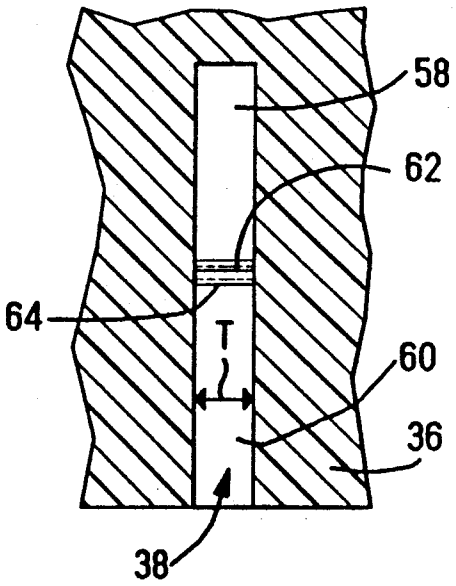
FIG. 4 is a cross sectional view taken along the line 4—4 in FIG. 3.
Figure 3:
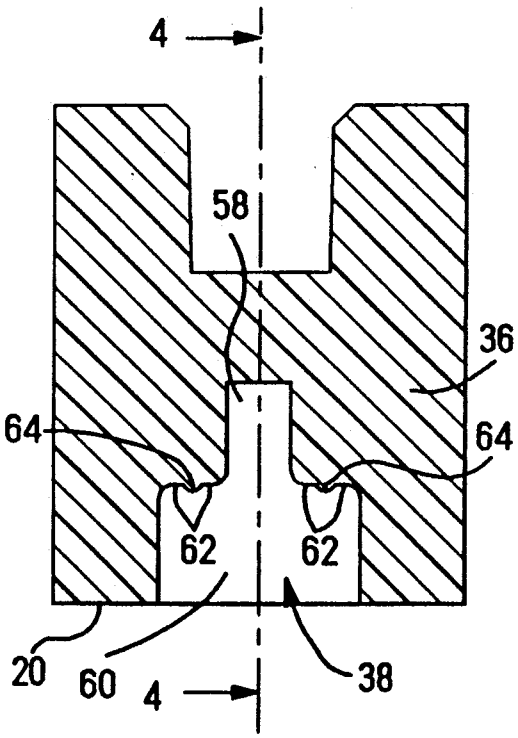
FIG. 3 is a cross sectional view showing a holding device receiving recess in a mounting portion of a housing according to this invention.
Figure 5:
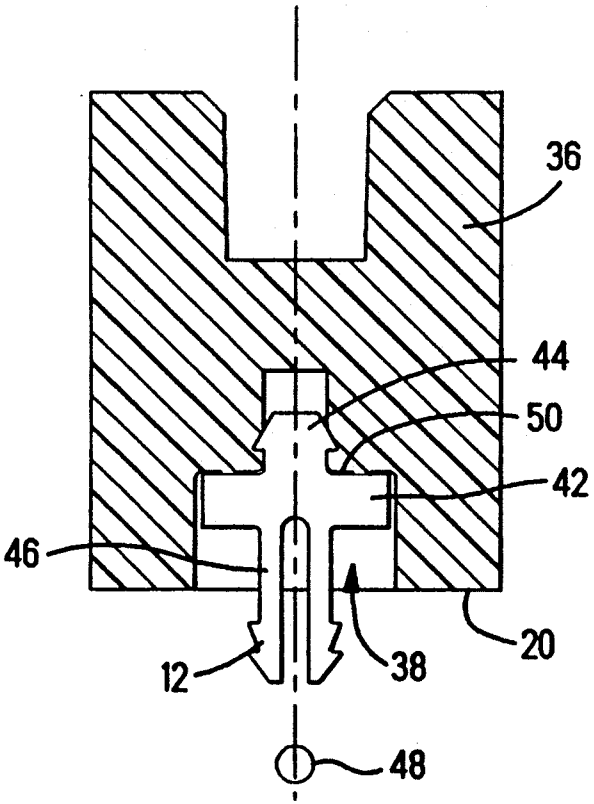
FIG. 5 is a view similar to FIG. 3 showing the holding device of FIG. 2 installed in the recess.

As shown in FIGS. 3 and 4, the holding device receiving recess 38 formed in the mounting portion 36 is generally planar and of uniform thickness T sufficiently greater than the thickness of the holding device 12 to provide clearance for the insertion of the holding device 12 in the recess 38. The recess 38 includes an inner portion 58 which is remote from the mounting face 20 and an outer portion 60 which is adjacent to and open to the mounting face 20. The width of the inner portion 58 is sized for an interference fit with the barbs 52 of the first projection 44 of the holding device 12, as is clear from FIG. 5. The outer portion 60 of the recess 38 has a generally flat inner wall 62 remote from and parallel to the mounting face 20. The inner wall 62 flanks the inner portion 58 of the recess 38. The width of the outer portion 60 is such that it freely accepts the central crossarm section 42 of the holding device 12 when the first projection 44 is inserted into the inner portion 58 of the recess 38, as is clear from FIG. 5.

In the absence of the inventive depth compensator to be described hereinafter, the edge 50 of the crossarm section 42 would engage the inner wall 62 to limit insertion of the holding device 12 into the recess 38. However, it has been found that it is very difficult to mold the recess 38 within the mounting portion 36 so as to maintain the inner wall 62 within required tolerances so that the holding device 12 is inserted to the proper depth and with the axis 48 orthogonal to the mounting face 20. More importantly, assembling the holding device 12 into the recess 38 to the proper depth without falling short, or bottoming and bending the holding device 12, is very difficult to achieve with mechanical insertion equipment which moves a preset distance, within a specified tolerance. What is desired is that the holding device 12 be backed up by the material of the mounting portion 36 when inserted into the recess 38 within the specified tolerance. According to this invention, a depth compensator is provided to insure that the holding device 12 is inserted into the recess 38 within an appropriate tolerance range and at the same time stabilize the holding device 12 within the recess 38 so that the axis 48 of the holding device 12 is orthogonal to the mounting face 20. The depth compensator, according to this invention, includes a pair of protrusions 64 formed on the inner wall 62 and extending equally from the inner wall 62. The protrusions 64 are formed one on either side of the inner portion 58 of the recess 38. Preferably, each of the protrusions 64 is semi-cylindrical in shape with an axis extending parallel to the inner wall 62 and across the thickness of the recess 38. It has been found that the radius of the cylindrical protrusions 64 should be on the order of approximately twice the tolerance being taken up.

Figure 6:
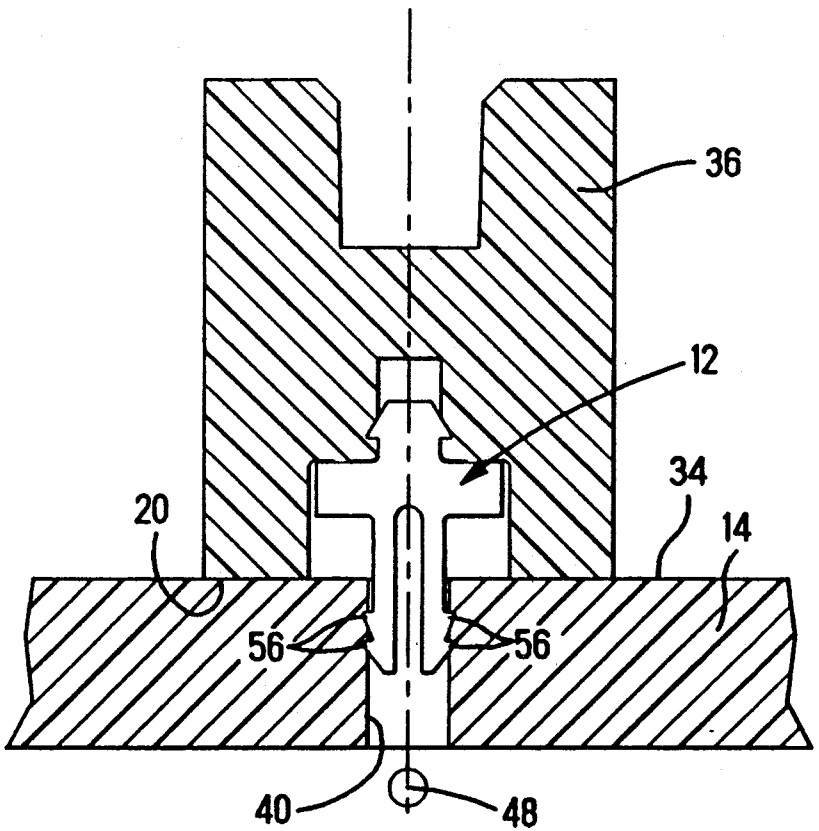
FIG. 6 is a cross sectional view showing the holding device of FIG. 2 inserted in both the recess of the mounting portion and an opening of a printed circuit board.

In use, the holding device 12 is inserted into the recess 38 with the first projection 44 leading. This is typically done by mechanical insertion equipment. The insertion equipment is set to insert the holding device 12 approximately half way into the protrusions 64. The deformation of the protrusions 64 provides the necessary tolerance take up and the protrusions 64 allow the holding device 12 to be seated without interfering with the inner wall 62. After the holding devices 12 are installed, the connector is assembled to the circuit board 14 by inserting the second projections 46 into the appropriately aligned cavities 40. The cavities 40 are preferably generally cylindrical with a diameter sized so that the barbs 56 engage the inner wall of each cavity 40, as best seen in FIG. 6. The separation of the legs 54 of the second projection 46 provides a spring action to assist in the insertion of the legs 54 into the cavities 40 and their subsequent retention therein.

Accordingly, there has been disclosed an improved arrangement for securing an electrical connector to a printed circuit board. While a preferred embodiment has been described, it is understood that various adaptations and modifications thereto are possible and it is only intended that this invention be limited by the scope of the appended claims.

We claim:

1. An arrangement for securing a first member (10) to a second member (14), said first member having a generally planar mounting surface (20) and said second member having a generally planar mounted surface (34), said second member being formed with a generally cylindrical cavity (40) open to said mounted surface, the arrangement comprising:

a holding device (12) formed as a unitary planar piece of uniform thickness and having a central crossarm section (42) and first (44) and second (46) projections extending in opposite directions from said central crossarm section within the plane of said holding device, said first and second projections together defining a major axis (48) of said holding device, said central crossarm section extending transverse to said major axis and laterally beyond said first and second projections, said central crossarm section having an edge (50) which is adjacent to said first projection and orthogonal to said major axis, each of said first and second projections being formed with at least one barb (52, 56), said second projection together with its associated at least one barb being sized for an interference fit with the inner wall of said second member cavity;

a mounting portion (36) on said first member, said mounting portion being formed with a holding device receiving recess (38) open to said mounting surface (20), said recess being generally planar and of uniform thickness sufficiently greater than the thickness of said holding device to provide clearance for insertion of said holding device, said recess having an inner portion (58) remote from said mounting surface and of width sized for an interference fit with said at least one barb (52) of said first projection of said holding device, said recess further having an outer portion (60) adjacent to and open to said mounting surface and of width sized to freely accept said central crossarm section of said holding device when said first projection is inserted in said inner portion of said recess, said outer portion of said recess having a generally flat inner wall (62) remote from and parallel to said mounting surface, said inner wall flanking said inner portion of said recess and being parallel to said edge of said central crossarm section; and a depth compensator for locating said holding device in said recess (38) of said first member mounting portion (36) including a pair of protrusions (64) formed on said inner wall (62) of said outer portion

(60) of said recess, said pair of protrusions extending equally from said inner wall and being one on either side of said inner portion (58) of said recess (38);

whereby said edge (50) of said central crossarm section (42) engages said pair of protrusions (64) when said holding device (12) is fully seated in said recess (38).

2. The arrangement according to claim 1 wherein each of said pair of depth compensator protrusions (64) is semi-cylindrical in shape with an axis extending parallel to said inner wall (62) of said outer portion (60) of said recess (38) and across the thickness of said recess.

3. The arrangement according to claim 1 wherein said holding device (12) second projection (46) is bifurcated along said major axis (48) to form a pair of separated legs (54) and each of said legs is formed with at least one barb (56) directed away from the other of said legs.

* * * * *